US005362087A

United States Patent [19]

Agid

[11] Patent Number: 5,362,087

[45] Date of Patent: Nov. 8, 1994

[54] SNOWBOARD BINDING RELEASE APPARATUS

[76] Inventor: Troy Agid, 8212 Rensselaer Way, Sacramento, Calif. 95826

[21] Appl. No.: 105,112

[22] Filed: Aug. 12, 1993

[51] Int. Cl.[5] ..... A63C 9/088

[52] U.S. Cl. ..... 280/611; 280/612; 280/14.2; 280/619

[58] Field of Search ..... 280/11.3, 611, 612, 280/619, 622, 623, 632, 633, 11.14, 14.2

[56] References Cited

U.S. PATENT DOCUMENTS

| | | | |
|---|---|---|---|
| 2,803,467 | 8/1957 | Von Opel | 280/611 |
| 3,246,907 | 4/1966 | Chisholm . | |
| 3,318,610 | 5/1967 | Kulick . | |
| 3,437,345 | 4/1969 | Berta | 280/612 X |
| 3,528,672 | 9/1970 | Wunder | 280/612 |
| 3,538,627 | 11/1970 | Labat-Camy | 280/611 X |
| 3,787,868 | 1/1974 | Camp . | |
| 3,794,339 | 2/1974 | Smolka | 280/612 |
| 4,125,274 | 11/1978 | Kubelka et al. | 280/611 X |
| 4,280,714 | 7/1981 | Salomon | 280/611 |
| 4,444,411 | 4/1984 | Svoboda et al. | 280/611 |
| 4,502,146 | 2/1985 | D'Antonio | 280/612 X |
| 4,973,073 | 11/1990 | Raines et al. | 280/633 X |
| 4,979,760 | 12/1990 | Derrah | 280/633 X |
| 5,029,890 | 7/1991 | Pfaffenbichler et al. | 280/613 |
| 5,085,453 | 2/1992 | Bildner | 280/612 |
| 5,150,913 | 9/1992 | Hoelzl | 280/612 |

FOREIGN PATENT DOCUMENTS

| | | | |
|---|---|---|---|
| 261457 | 4/1968 | Austria | 280/611 |
| 2221424 | 11/1973 | Germany | 280/612 |

*Primary Examiner*—Mitchell J. Hill
*Assistant Examiner*—Carla Mattix
*Attorney, Agent, or Firm*—Thomas R. Lampe

[57] ABSTRACT

Apparatus for use in combination with a snowboard to allow release of the snowboard binding straps from a location spaced from the snowboard. The release mechanism employed to delatch latch members connected to the binding straps may be either electrically or manually operated.

9 Claims, 4 Drawing Sheets

SNOWBOARD BINDING RELEASE APPARATUS

TECHNICAL FIELD

This invention relates to snowboards. More particularly, the invention pertains to apparatus for releasing the binding of a snowboard from a location spaced from the snowboard.

BACKGROUND ART

The sport of snowboarding has become increasingly popular not only in the United States but also around the world. When utilizing a snowboard, an individual places both of his or her feet on the upper surface of the snowboard. The user's footwear is maintained in fixed position on the snowboard by bindings which securely hold the footwear in place and prevent relative movement between the snowboard and the footwear. Snowboard bindings differ from those employed in connection with skis in a number of respects, one of the most significant differences being that ski bindings allow release of the user's foot upon application of outside forces such as those caused by impact or other source of stress forces. Snowboards, on the other hand, conventionally provide release only when the user manually releases the bindings at the location of the snowboard. While impact releases for snowboards have been proposed, they are characterized by their relative complexity. Nor do such impact releases effectively solve the problem this invention addresses—ready and reliable release of a snowboard binding manually from a location spaced from the snowboard. Snowboard binding impact releases are not generally desirable in any event since they can result in only a single foot being released, which can cause injury.

The requirement that prior art snowboard bindings must be released manually at the snowboard itself has resulted in injury to and death of snowboarders under certain circumstances. For example, snowboarders have died when covered by snow due to their inability to release the snowboard bindings. Such a predicament is fairly common and is not limited to a snowboarder being buried by an avalanche. Snowboarders can be, and are, buried simply due to the fact that powder or other treacherous snow conditions are encountered. The snowboarder can be entombed because he or she cannot release the snowboard. Impact releases do not provide a reliable means for effecting separation under such circumstances.

The following United States patents are believed to be representative of the state of the prior art: U.S. Pat. No. 3,794,339, issued Feb. 26, 1974, U.S. Pat. No. 5,150,913, issued Sep. 29, 1992, U.S. Pat. No. 3,787,868, issued Jan. 22, 1974, U.S. Pat. No. 3,246,907, issued Apr. 19, 1966, U.S. Pat. No. 5,029,890, issued Jul. 9, 1991, U.S. Pat. No. 4,502,146, issued Feb. 26, 1985, U.S. Pat. No. 4,444,411, issued Apr. 24, 1984, U.S. Pat. No. 5,085,453, issued Feb. 4, 1992, U.S. Pat. No. 4,280,714, issued Jul. 28, 1981, and U.S. Pat. No. 3,318,610, issued May 9, 1967.

As can be seen with reference to the above-noted patents, a variety of binding systems exist for skis and snowboards. Many such systems are impact-actuated, that is, the bindings will release responsive to forces applied at the bindings of a certain magnitude and character. While some of the patents suggest the use of remotely actuated binding releases, the mechanisms disclosed are not appropriate for or applicable to snowboards. Such systems may, for example, lack the degree of reliability one would wish for under numerous situations. Prior art ski binding releases and snowboard impact-type binding releases are also generally characterized by their relative complexity and high expense.

DISCLOSURE OF INVENTION

The present invention relates to an apparatus which is employed with snowboards to reliably and efficiently allow release of the snowboard bindings from a location spaced from the snowboard and bindings. In addition to its reliability, the apparatus of the present invention is characterized by its relative simplicity and low expense. The apparatus may be made available on new snowboards or retrofitted on existing boards due to the modular character of the apparatus. Apparatus constructed in accordance with the teachings of the present invention is utilized with and employed for each foot so that the bindings and apparatus may be positioned at locations on the snowboard selected by the user.

The apparatus of the present invention is for use in combination with a snowboard having an upper surface and a bottom surface. The apparatus incorporates snowboard binding means including at least one strap movable between a first position wherein the at least one strap is in engagement with footwear of a person employing the snowboard and positioned over the footwear to securely retain the footwear between the snowboard and snowboard binding means and in position on the snowboard and a second position wherein the at least one strap permits ready removal of the footwear from the snowboard and from the at least one strap.

The apparatus also has latch means including first and second latch members operatively associated with the snowboard binding means to maintain said at least one strap in said first position to securely retain the footwear between the snowboard and the snowboard binding means when the first and second latch members are connected.

Release means is operatively associated with the latch means for unlatching the first and second latch members to allow the at least one strap to move to the second position from the first position whereby the footwear may be readily removed from the snowboard.

The release means includes a manually actuatable release element actuatable by a person employing the snowboard to unlatch the first and second latch members and allow separation of the first and second latch members by application of force on the at least one strap in a direction away from the snowboard. The manually actuatable release element is at a location spaced from the snowboard.

The apparatus additionally comprises support means for supporting the snowboard binding means, the latch means, and at least a portion of the release means. The support means is for connection to the upper surface of a snowboard whereby the snowboard binding means, the latch means and the release means portion may be selectively affixed to the snowboard at any desired location thereon or removed therefrom as a module.

Other features, advantages, and objects of the present invention will become apparent with reference to the following description and accompanying drawings.

MODES FOR CARRYING OUT THE INVENTION

Figure 1:
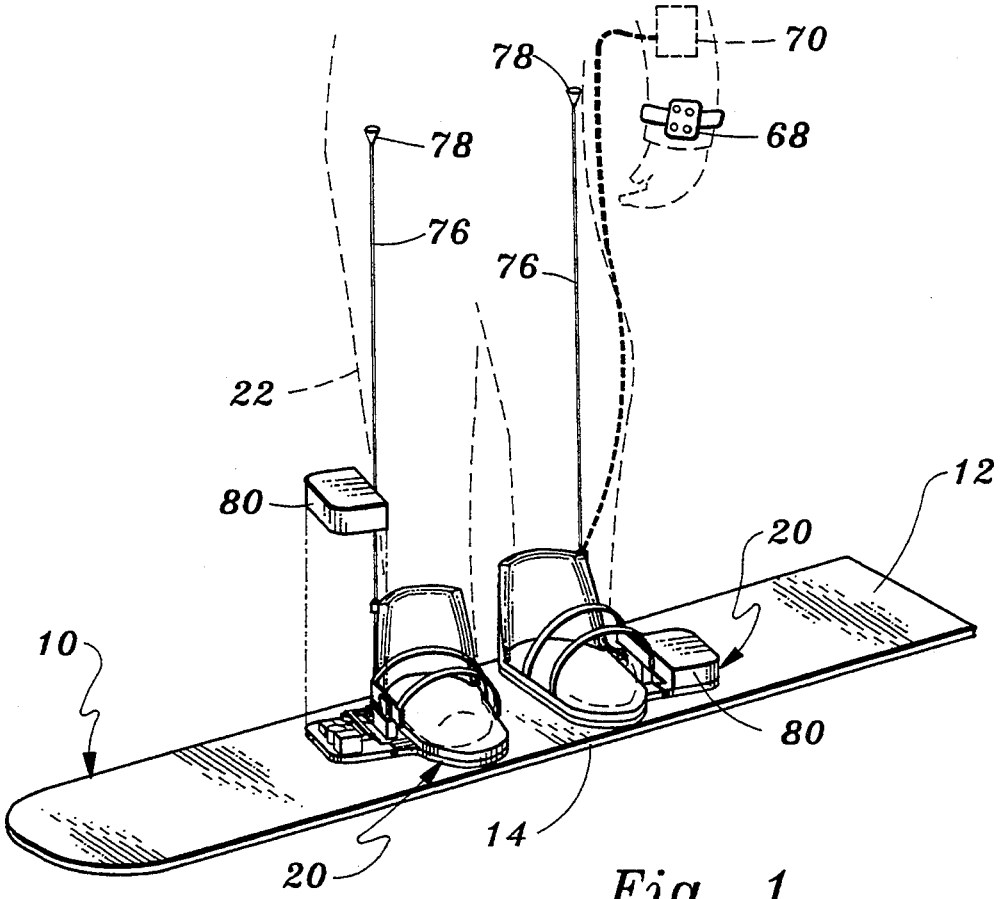
FIG. 1 is a frontal, perspective view showing a snowboard and snowboard bindings with apparatus constructed in accordance with the teachings of the present invention.

Referring to the drawings, apparatus constructed in accordance with the teachings of the present invention is for use with a snowboard 10 having an upper surface 12 and a bottom surface 14.

FIG. 1 shows two apparatus constructed in accordance with the teachings of the present invention positioned on the upper or top surface of snowboard 10, each apparatus being designated by reference numeral 20. Since, as will be pointed out in greater detail below, apparatus 20 is of modular construction, positioning thereof relative to snowboard 10 can be accomplished in accordance with the wishes of the user of the snowboard. That is, one snowboarder may prefer a different placement of his or her feet than does another snowboarder. The apparatus of the present invention may be secured to a snowboard in accordance with such wishes by any suitable fastening means such as screws (not shown). FIG. 1 depicts a snowboarder 22 in dash lines.

Figure 2:
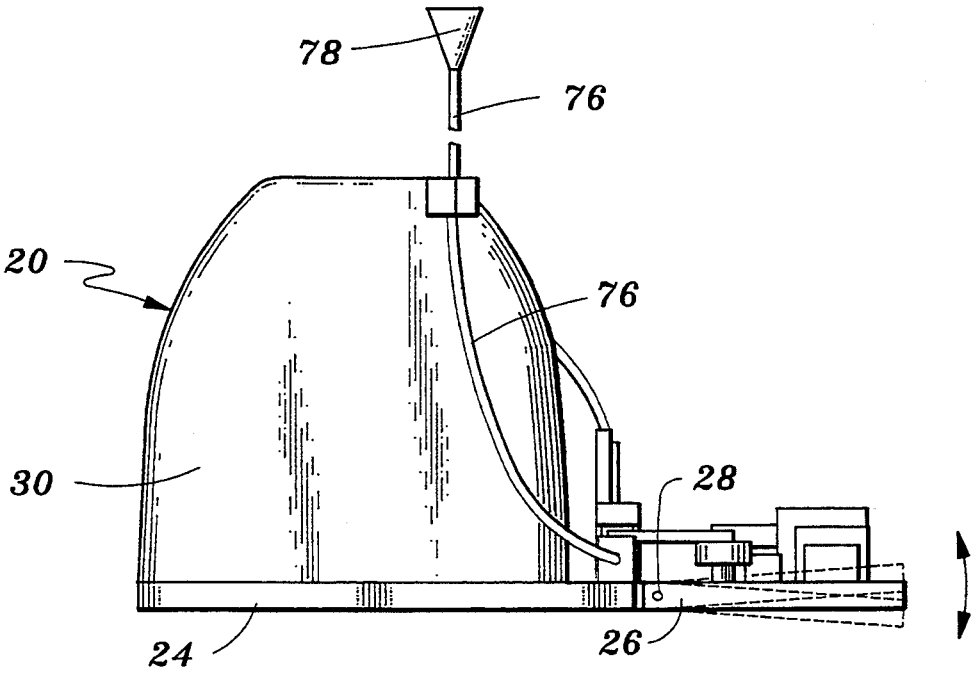
FIG. 2 is a rear, elevational view of the apparatus removed from the snowboard.
Figure 3:
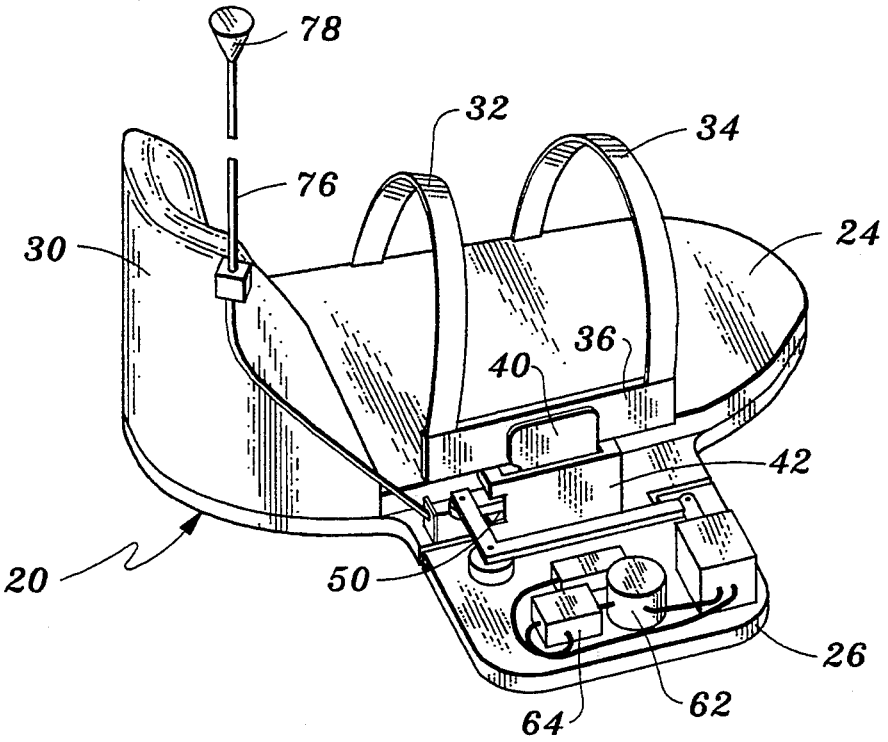
FIG. 3 is a perspective view of the apparatus.

Each apparatus 20 includes support means in the form of two pivotally connected support members or plates 24 and 26. Pivotal attachment by pivot or hinge 28 allows some degree of pivotal movement between the support members as shown by the arrow and dash line depictions of support member 26 in FIG. 2. This approach ensures that the apparatus 20 will not impede normal flexure of the snowboard 10 during use.

A heel plate 30 extends upwardly from support member 24 as do two binding straps 32, 34. Straps 32, 34 are affixed at the distal ends thereof to a rigid connector element in a form of a plate 36 of metal or the like.

A male latch member 40 is affixed to plate 36. Male latch member 40 is for positioning in female latch member 42 affixed to support member 24 and projecting upwardly therefrom. Latch members 40, 42 may be of any suitable construction and in the illustrated embodiment of the present invention such latch members are essentially of the same construction as latch members commonly employed to secure seat belts.

A lock member 50 is movable in and out of a recess 52 formed in female latch member 42, it being appreciated that lock member 50 enters a recess 54 in male latch member 40 to retain latch members 40, 42 together in latched condition. Withdrawal of lock member 50 from recess 52, on the other hand, will allow ready disengagement between the latch members 40, 42 and separation thereof upon application of a force, such as by lifting the foot, on one or both of the binding straps 32, 34 in a direction away from the snowboard 10.

Figure 4:
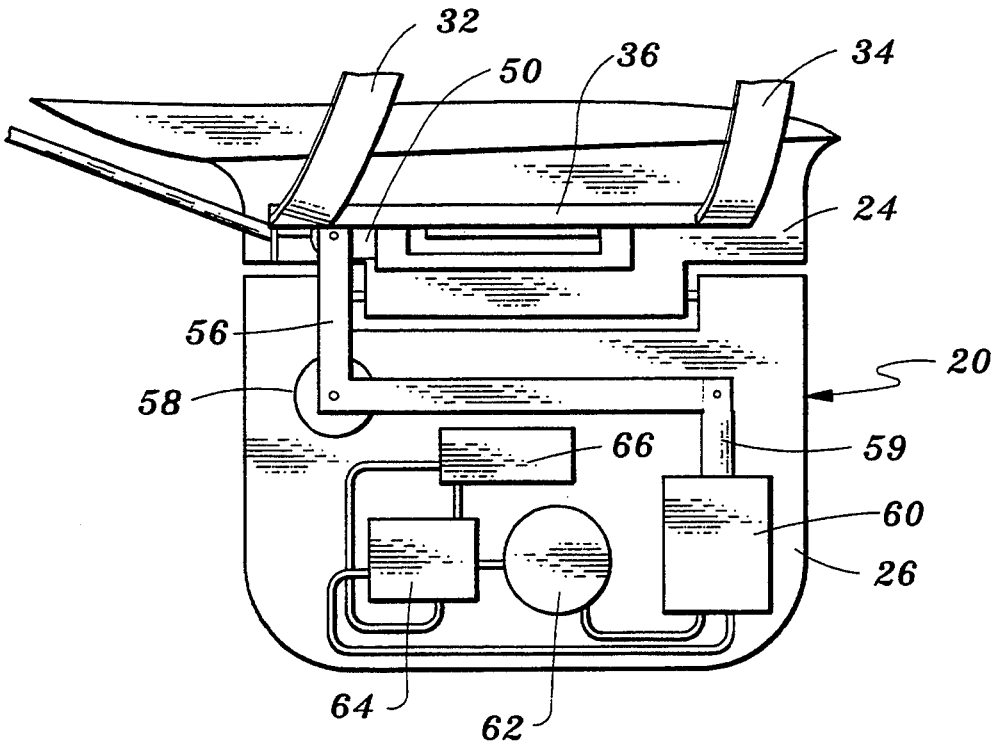
FIG. 4 is an enlarged, top plan view of a portion of the apparatus.
Figure 5:
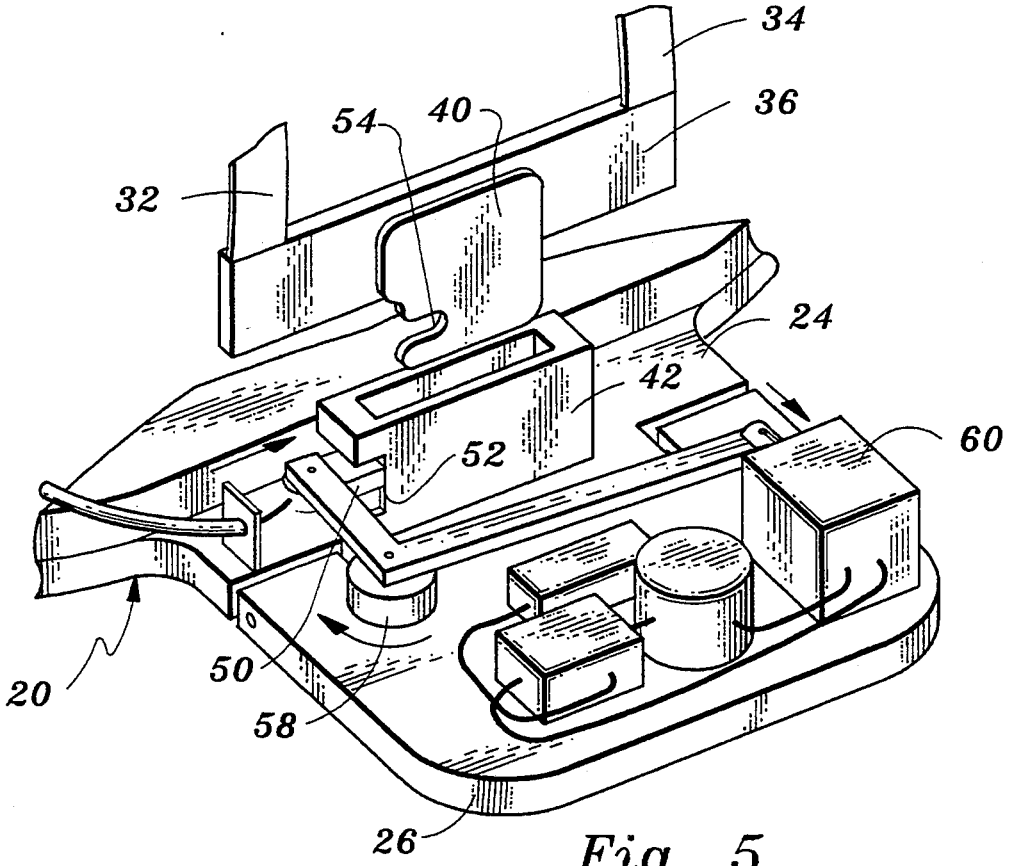
FIG. 5 is an enlarged, fragmentary, perspective view illustrating the operation of selected components of the apparatus.

Lock member 50 is connected to an end of an L-shaped lever 56 pivotally mounted on support member 26 by pivot post 58. When the lever 56 is in position illustrated in FIG. 6, the lock member 50 will lock the latch members 40, 42 together and prevent separation thereof. When, however, the L-shaped lever 56 is in the position shown in FIG. 4, latch members 40, 42 may readily be de-latched.

Figure 6:
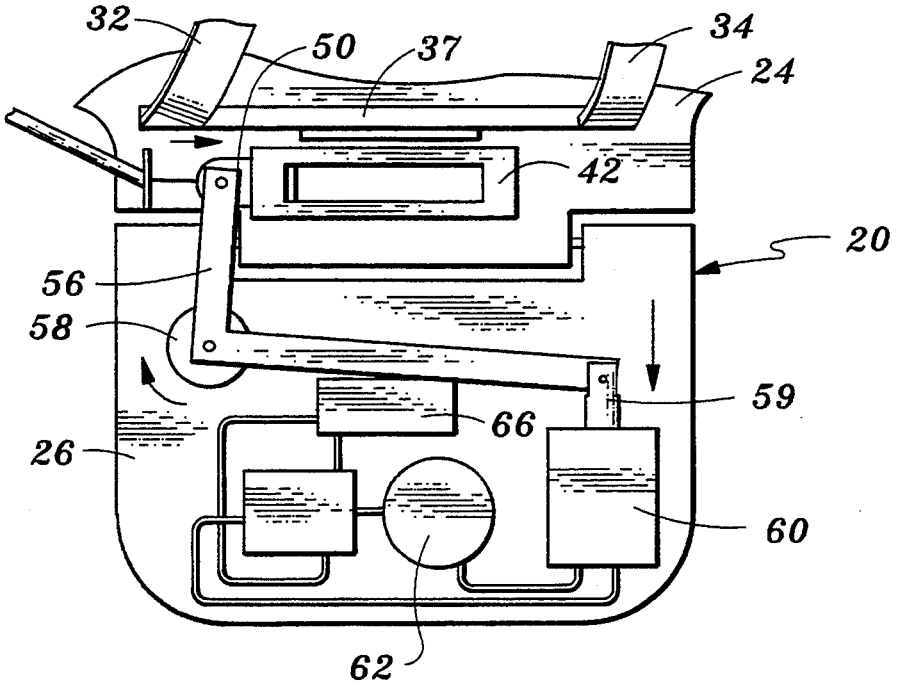
FIG. 6 is a view similar to FIG. 4, but illustrating components of the apparatus in alternate relative positions.

The end of lever 56 remote from lock member 50 is connected to the armature 59 of a solenoid 60. When the solenoid 60 is de-energized it will retract armature 59 as shown in FIG. 6 and cause lock member 50 to lock together latch members 40, 42. Energization of the solenoid 60 will cause the spring biased armature to return to its extended position and the lever 56 to rotate in a counter-clockwise direction and withdraw lock member 50 from female latch member 42.

Solenoid 60 is energized by a battery 62 in operative association therewith through suitable wiring. The battery itself may be a 12-volt battery with the solenoid having a like rating. An electrical lead runs from battery 62 to a 12-volt relay 64. Relay 64 is hardwired to solenoid 60 and to a radio receiver 66.

Figure 7:
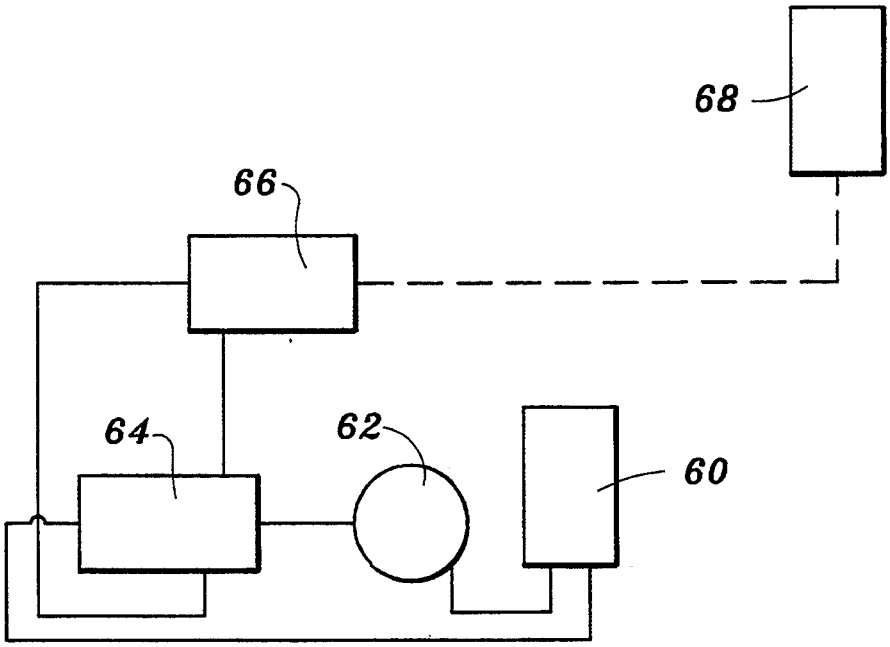
FIGS. 7 and 8 are alternative schematic diagrams pertaining to the latch means and release means of the invention.

Radio receiver 66 is for receiving a signal from a transmitter 68 (FIG. 1) which is to be worn by the snowboarder, for example about his or her wrist. Actuation of the transmitter is accomplished by pushing an actuator button thereon. Radio receiver 66 energizes relay 64 allowing electrical current to flow from the battery to the solenoid. This causes extension of the solenoid armature and causes release of the latch members as described above. FIG. 7 depicts in general schematic fashion the arrangement just described.

Figure 8:
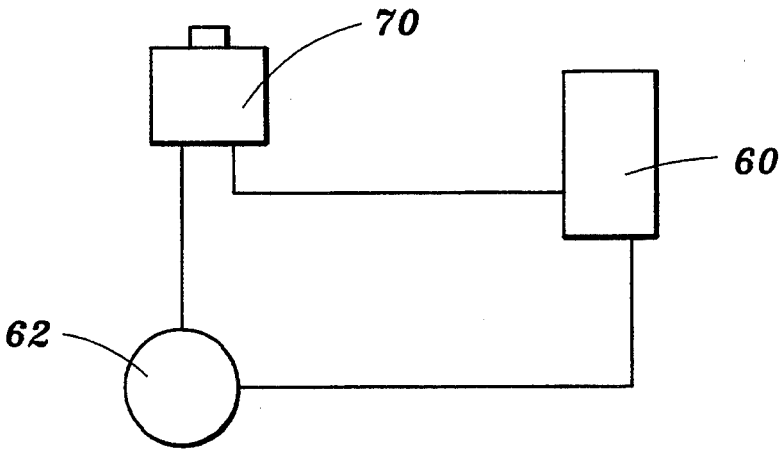

FIG. 8 shows an alternative arrangement wherein solenoid 60 is in series with battery 62 and a manually actuatable switch 70. FIG. 1 depicts in dash line a switch 70 carried by the snowboarder rather than the radio transmitter, the wiring connecting the switch 70 to the rest of the system also being depicted in dash lines.

The drawings also illustrate an arrangement in which release of the lock member 50 may be effected on a completely manual basis. This arrangement may be employed in lieu of the electrically operated mechanisms described above or as a backup thereto. The manual release system includes a flexible cable 76 which is connected to lock member 50. Pulling of the cable 76 by the snowboarder is effected by grasping release handles 78 and pulling same. With an appropriate modification, release could be effected by pushing a cable.

In use, the components of the apparatus which are on support member 26 are preferably covered by a cover 80. FIG. 1 shows a cover 80 on one of the apparatus 20 and prior to placement on the other. Suitable fastener means may be employed to secure the cover 80 to the remainder of the apparatus as well as to secure the apparatus itself to a snowboard.

I claim:

1. Apparatus for use in combination with a snowboard having an upper surface and a bottom surface, said apparatus comprising, in combination:

snowboard binding means including at least one strap movable between a first position wherein said at least one strap is in secure binding engagement with the vamp of footwear of a person employing said snowboard and positioned over said footwear vamp and about opposed sides of the footwear to securely retain the footwear between the snowboard and snowboard binding means and in fixed position on the snowboard and a second position wherein the at least one strap is freely movable relative to said snowboard and permits ready movement of the footwear away from the snowboard upper surface and removal of the footwear from the snowboard and from the at least one strap in a direction generally normal to said snowboard upper surface;

latch means including first and second latch members operatively associated with said snowboard binding means to maintain said at least one strap in said first position to securely retain the footwear between the snowboard and the snowboard binding means when said first and second latch members are connected;

release means operatively associated with said latch means for unlatching said first and second latch members to allow said at least one strap to move to said second position from said first position whereby the footwear may be readily removed from said snowboard, said release means including a manually actuatable release element actuatable by a person employing said snowboard to unlatch said first and second latch members and allow complete separation of said first and second latch members by application of force on said at least one strap by said footwear vamp in a direction generally normal to and away from said snowboard upper surface, said manually actuatable release element being at a location spaced from said snowboard; and support means for supporting said snowboard binding means, said latch means, and at least a portion of said release means, said support means releasably connected to the upper surface of said snowboard whereby said snowboard binding means, said latch means and said release means portion may be selectively positioned relative to, affixed to, or removed from said snowboard, said at least one strap having a distal end, said first latch member being connected to said distal end and said distal end and said first latch member being located alongside a side of said footwear when said at least one strap is in said first position, and said second latch member being fixedly secured to said snowboard upper surface and projecting therefrom, said latch means additionally comprising a lock member movable relative to said snowboard and to said first and second latch members between a lock position wherein said lock member positively locks together said first and second latch members and an unlock position wherein said first and second latch members are unlocked, said first latch member being freely movable relative to and completely separable from said second latch member when said lock member is in said unlock position upon application of a force on said at least one strap by said footwear vamp upon movement of said footwear in a direction generally normal to said snowboard upper surface.

2. The apparatus according to claim 1 wherein said release means includes an electrically operated solenoid for moving said lock member relative to said first and second latch members to unlatch said first and second latch members, said release means additionally including a source of electrical energy operatively associated with said solenoid to move said lock member responsive to manual actuation of said manually actuatable release element.

3. The apparatus according to claim 2 additionally comprising radio receiver means in operative association with said electrically operated solenoid to energize said solenoid responsive to a radio signal received by said radio receiver means, said manually actuatable release element comprising a manually operated radio transmitter for transmitting a radio signal to said radio receiver means.

4. The apparatus according to claim 2 additionally comprising electrical wiring in operative association with said electrically operated solenoid, said manually actuatable release element comprising a manually operated switch connected to said wiring for completing a current between said source of electrical energy and said solenoid.

5. The apparatus according to claim 1 wherein said release means includes an elongated actuator element extending between said locking member and said manually actuatable release element, manual actuation of said manually actuatable release element by a person employing said snowboard causing movement of said elongated actuator element and said lock member for unlocking said first and second latch members from latched engagement.

6. The apparatus according to claim 1 wherein said binding means comprises a plurality of straps affixed to said first latch member.

7. The apparatus according to claim 6 wherein said plurality of straps have distal ends, said apparatus additionally comprising a rigid connector element connected to said distal ends and to said first latch member.

8. The apparatus according to claim 2 additionally comprising a lever arm interconnecting said electrically operated solenoid and said lock member.

9. The apparatus according to claim 2 additionally comprising support means for supporting said snowboard binding means, said latch means, said solenoid, and said source of electrical energy, said support means including two relatively moveable support members, at least one of said support members for supporting the footwear of a person employing said snowboard.

* * * * *